United States Patent [19]

Maier

[11] Patent Number: 4,565,261

[45] Date of Patent: Jan. 21, 1986

[54] DETACHABLE GALLERY FOR USE ON BUILDINGS OR THE LIKE

[76] Inventor: Josef Maier, Schwimmbadstr. 3, D-7611 Steinach, Fed. Rep. of Germany

[21] Appl. No.: 592,244

[22] Filed: Mar. 22, 1984

[30] Foreign Application Priority Data

Mar. 22, 1983 [DE] Fed. Rep. of Germany ..... 3310317

[51] Int. Cl.[4] ..... E04G 3/00

[52] U.S. Cl. ..... 182/113; 182/82

[58] Field of Search ..... 182/82, 113, 83–86; 49/255, 256, 394; 292/183, 189, 63, 67

[56] References Cited

U.S. PATENT DOCUMENTS

| | | | |
|---|---|---|---|
| 119,141 | 9/1871 | Hathaway | 49/394 |
| 969,925 | 9/1910 | Wheeling | 49/255 |
| 1,723,007 | 8/1929 | Bittorf | 49/394 |
| 1,944,382 | 1/1934 | Wecker | 292/183 |
| 4,090,585 | 5/1978 | Laub | 182/82 |

FOREIGN PATENT DOCUMENTS

| | | |
|---|---|---|
| 1713947 | 11/1955 | Fed. Rep. of Germany . |
| 1105136 | 1/1957 | Fed. Rep. of Germany . |
| 1607071 | 5/1966 | Fed. Rep. of Germany . |
| 2329263 | 6/1973 | Fed. Rep. of Germany ..... 49/255 |

*Primary Examiner*—Reinaldo P. Machado
*Attorney, Agent, or Firm*—Peter K. Kontler

[57] ABSTRACT

A gallery for use as a means for supporting workmen and/or materials at levels above the ground has a platform, a balustrade extending upwardly from one longitudinal marginal portion of the platform, and a gate which is secured to the balustrade by one or more aligned hinges having a pintle defining for the gate a vertical pivot axis for movement between an open position in which one side of the gate is adjacent to the inner side of the balustrade and a closed position in which the lower portion of the gate abuts against a stop mounted on the platform and being spaced apart from the balustrade. In order to enable the gate to pivot beyond such closed position, the hinge or hinges allow the gate to be lifted to a level above the stop so that it can bypass the stop and move to a second open position in which its other side is adjacent to the inner side of the balustrade. The stop can define a vertical recess which can receive a portion of the gate so that the latter is locked in the closed position. A bolt, hook or the like can be provided to secure the gate in the closed position or in the selected open position.

22 Claims, 2 Drawing Figures

DETACHABLE GALLERY FOR USE ON BUILDINGS OR THE LIKE

BACKGROUND OF THE INVENTION

The present invention relates to devices which can support persons and/or material at a level above the ground, e.g., in front of the facades of buildings which are being erected, cleaned, inspected, painted and/or otherwise treated. More particularly, the invention relates to a working platform or gallery which can be used for the above outlined or analogous purposes and which is provided with a gate to enhance the safety of persons occupying the gallery and/or to reduce the likelihood of accidental gravitational descent of building material and/or tools to the ground.

It is known to provide a gallery with a gate (e.g., a swingable door) which is mounted at one end of the walking platform and serves as a means for reducing the likelihood of accidents including injury to the occupant(s) of the gallery and/or injury or damage to persons or property below the gallery, such as by accidentally dropped building material which is stacked on the gallery. It is further known to provide such galleries with means for locking the gate in closed position so that a workman is less likely to accidentally open the gate if the latter is located at one end of the platform and its opening could result in serious injury or even death as a result of fall to the ground or onto a portion of an edifice at a level below the gallery. For example, the gate will be closed and locked if there is no other barrier at the respective end of the gallery. However, the gate can be unlocked and opened if the gallery is installed between two spaced-apart walls which are provided with openings and doors for such openings so that there is no need for an extra gate on the gallery proper.

When the gallery is removed from the finished, inspected and/or repaired building, the gate is normally detached therefrom, either alone or with the framework in which the gate is installed. The gallery is then kept in storage or transported to a new locale of use where the gate must be reinstalled so as to be movable to a closed position. This can present many problems if the new locale of use is such that the gate must be swung to an open position which is different from that at the previous locale of use. For example, if the gate is pivotable, the circumstances prevailing at a first locale of use may be such that the gate must be pivoted clockwise in order to move from an open to a closed position. On the other hand, the conditions at the next locale of use may be such that a movement of the gate from open to closed position necessitates pivoting in a counterclockwise direction. A situation which is likely to arise is that when the gallery is installed between two erected walls at least one of which has an opening in mere partial register with the space above the adjacent end portion of the platform. If the gate is designed to swing outwardly in order to assume the open position, the opening in the respective wall is likely to be too small or not sufficiently aligned with the gate to enable the latter to move to its open position.

OBJECTS AND SUMMARY OF THE INVENTION

An object of the invention is to provide a gallery which has at least one gate (e.g., a pivotable door) which is constructed and assembled in such a way that the door can be moved between at least one open position and a closed position as well as beyond such closed position (e.g., to a second open position) when the need arises.

Another object of the invention is to provide a gallery whose versatility greatly exceeds that of presently known galleries and which can be installed in or on bridges, buildings or like structures irrespective of whether or not the gate or gates must be moved clockwise or counterclockwise in order to assume their open or closed positions.

A further object of the invention is to provide a gallery which has a gate at one end, at each end or at each end and at one or more locations between the ends, and wherein each and every gate can be used (i.e., moved to open or closed position) irrespective of the conditions prevailing at the locale of use of the gallery.

An additional object of the invention is to provide the gallery with novel and improved means for securing the gate or gates to its support and with novel and improved means for locking the gate or gates in one or more selected positions.

Still another object of the invention is to provide a novel and improved gate for use in a structure of the above outlined character.

An additional object of the invention is to provide a gallery wherein the mobility of the gate or gates with reference to the platform and/or other parts of the gallery is much more pronounced than in heretofore known galleries.

A further object of the invention is to provide a gate and adjuncts which can be installed in existing galleries as superior substitutes for heretofore known gates.

An ancillary object of the invention is to provide a novel and improved method of manipulating the gate or gates in a gallery of the above outlined character.

An additional object of the invention is to provide a gallery wherein the gate which is installed at one end of the platform (or each of the gates installed at the ends of the platform) can be moved to open position irrespective of the availability or lack of availability of space adjacent to the respective end of the platform.

The invention is embodied in a gallery which can be usedon buildings above the ground level to provide a path for workmen as well as to provide room for storage of building material or the like. The gallery comprises a support (such support can comprise an elongated platform and a balustrade or railing extending upwardly from one marginal portion of the platform), a gate (e.g., a door or any other device which can serve as a barrier to prevent the workmen from moving along the platform and beyond the gate when the latter is held in closed position), one or more hinges or other suitable means for articulately connecting the gate to the support so that the gate is movable between at least one open position and a closed position as well as between a raised and a lowered position, at least while the gate assumes or approaches the closed position, and blocking means provided on the support and disposed in the path of movement of the gate in a direction from the open position beyond the closed position. The configuration and mounting of the blocking means and of the gate are such that the gate can bypass the blocking means in the raised position thereof. The gate can be mounted at or close to one end of the platform, and the gallery can comprise one or more additional gates which can be mounted at selected locations, e.g., one at the other end of the platform and another substantially midway between the ends of the platform.

As mentioned above, the connecting means can comprise at least one hinge which preferably defines an at least substantially vertical pivot axis for movement of the gate between open and closed positions. The blocking means is preferably mounted on the platform at a location which is remote from the balustrade and is mounted in the path of movement of the lower portion of the gate when the latter is held in (or allowed by gravity to assume) the lowered position. The lower portion of the gate is located at a level above the blocking means when the gate is moved to its raised position. Means can be provided for releasably locking the gate in the closed position; such locking means can constitute an integral part of the blocking means or it may be a discrete component (e.g., a reciprocable locking bolt) which can be moved into and from engagement with the blocking means, with the platform or with the balustrade while the gate is held in the closed position. The gate is preferably movable to either side of the blocking means when it is moved to the raised position. The locking means can be arranged to releasably lock the gate while the latter is adjacent to the one or the other side of the blocking means. The blocking means can comprise a socket which is open from above, and the aforementioned lower portion of the gate is then located at a level above the socket when the gate is moved to its raised position. This renders it possible to insert the lower portion of the gate (or a projecting part which is carried by the lower portion of the gate or is adjacent to the lower portion of the gate) into the socket when the gate is moved to raised position and is pivoted or otherwise moved from open position to a position in which the lower portion registers with the open upper side of the socket so that the lower portion automatically enters the socket when the gate is moved to its lowered position. The blocking means can comprise a substantially U-shaped member with two prongs which flank a recess constituting the aforementioned socket. The thickness of that portion of the gate which is to enter the socket is at least slightly less than the width of the recess.

The hinge or hinges which constitute or form part of the connecting means include a preferably vertical pintle defining the aforementioned pivot axis for movement of the gate between open and closed positions. Each hinge has at least one eyelet or leaf for the pintle, and such eyelet or eyelets permit the gate to move between its raised and lowered positions. For example, the eyelet or eyelets can be provided on the support (particularly on the balustrade) and the pintle can be affixed to the gate so that its lower end portion extends downwardly below the lowermost eyelet. Such lower end portion of the pintle can be provided with or can constitute a means for limiting the extent of movement of the gate between its raised and lowered positions as well as for preventing complete detachment of the gate from the support. For example, the limiting means can include an enlargement which is attached to or forms part of the pintle and cannot pass through at least one of the eyelets so that it abuts against the one eyelet in the raised position of the gate.

The blocking means is preferably remote from the balustrade of the support; it can be affixed to or made integral with that portion of the platform which is remote from the balustrade and is adjacent to the outer side of a wall forming part of a building or the like on which the gallery is mounted.

The gallery preferably further comprises means for releasably securing the gate to the support in the open position of the gate. Such securing means can comprise a hook, a bolt or an analogous portion which is mounted on the gate and is remote from the pivot axis which is defined by the pintle. Such portion of the securing means is preferably connectable to the balustrade and is or can be adjustably mounted on the gate so as to ensure that it can be properly secured to a portion of the balustrade, e.g., to one of the upright posts which carry one or more horizontal rails.

The novel features which are considered as characteristic of the invention are set forth in particular in the appended claims. The improved gallery itself, however, both as to its construction and the mode of assembling and utilizing the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
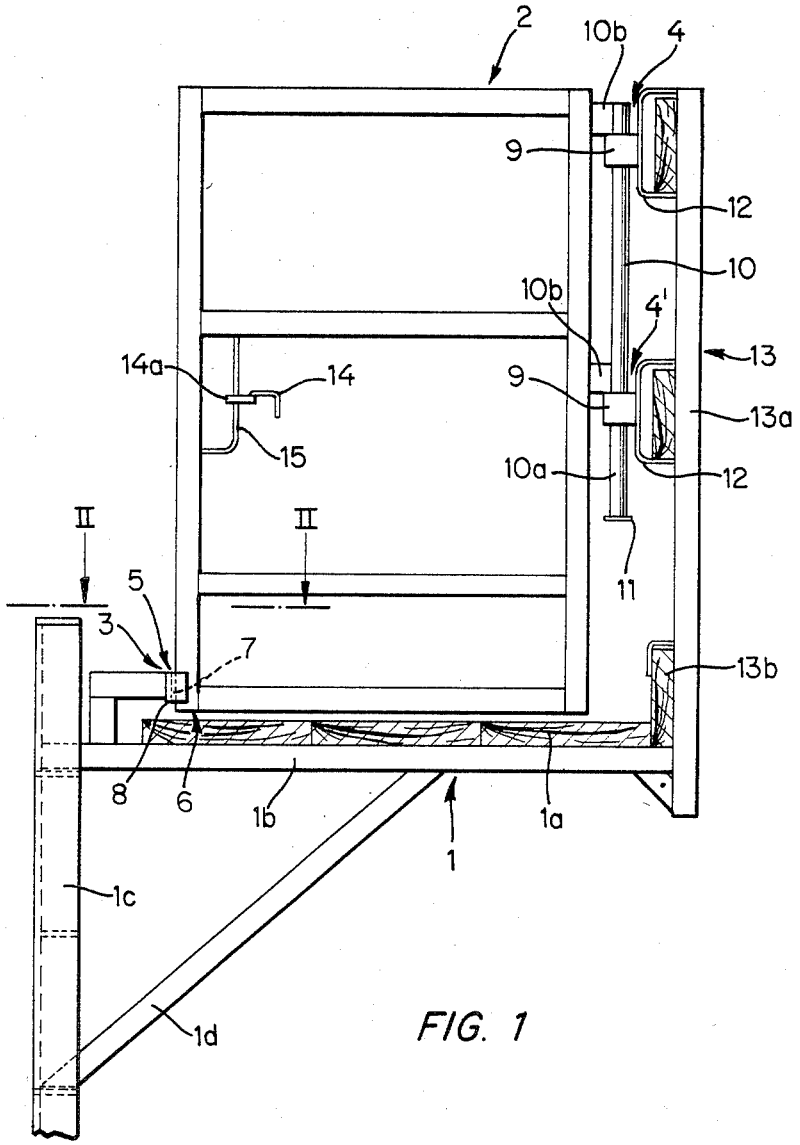
FIG. 1 is a transverse vertical sectional view of a gallery which embodies one form of the invention, the gate being closed and being held by gravity in the lowered position so that a portion thereof extends into the recess of a U-shaped blocking device.

The working platform or gallery which is shown in the drawing comprises a support including a platform 1 having planks 1*a* mounted on horizontal beams 1*b* which are secured to vertical beams 1*c*. The platform 1 is reinforced by suitably inclined braces 1*d*. That marginal portion of the platform 1 which is remote from the beams 1*c* (i.e., from the wall on which the gallery is mounted or adjacent to which the gallery is installed) carries a balustrade or railing 13 including vertical posts 13*a* and horizontal rails 13*b*. The gallery can be used at the outer sides of buildings or other tall structures which are in the process of being erected or which must be inspected, repaired, cleaned, painted and/or otherwise treated by one or more workmen standing on the platform 1. The manner in which the beams 1*c* can be secured to a wall may be the same as disclosed in commonly owned copending patent application Ser. No. 592,243 filed Mar. 22, 1984 for Working Platform.

The illustrated gallery further comprises a gate 2 which can resemble or constitute a simple door and is installed at the one or the other end of the platform 1 or anywhere between such ends. The gate 2 is pivotable about the vertical axis of a pintle 10 forming part of a two-piece hinge including an upper hinge 4 and a lower hinge 4'. Each of these hinges has an eyelet 9 which is secured to the adjacent horizontal rail 13*b* or the adjacent post 13*a* of the balustrade 13 by a U-shaped metallic member 12. The lower portion 10*a* of the pintle 10 normally extends downwardly and beyond the lower eyelet 9 and its free end carries a disc-shaped or washer-like member 11 which constitutes a means for limiting the extent of upward movement of the pintle 10 relative to the eyelets 9. Thus, when the gate 2 is held in the illustrated lowered position, the member 11 is remote from the lower eyelet 9. The extent to which the gate 2 can be raised above and away from the platform 1 is determined by the distance between the member 11 and the lower eyelet 9. When the gate 2 is lifted, the pintle 10 (which is secured to the gate, as at 10*b*) moves upwardly and is arrested when the member 11 engages the underside of the lower eyelet 9. Such upward movement of the gate 2 to its raised position suffices to move the lower portion 6 of the gate to a level above a blocking device 3 which is a substantially U-shaped stop affixed to the platform 1 at a location remote from the balustrade 13. At such time, the gate 2 can be pivoted beyond the illustrated closed position, namely, to either side of the blocking device 3. In other words, the gate 2 can be pivoted about the axis of the pintle 10 from a first open position in which one side of the gate (e.g., the rear side, as viewed in FIG. 1) abuts against the inner side of the balustrade 13, to a closed position which is shown in the drawing and in which the gate extends substantially at right angles to the balustrade 13, and from such closed position back to the first open position or, alternatively, to a second open position in which the other side of the gate is adjacent to the inner side of the balustrade. In order to move beyond the closed position, the gate 2 must be lifted with the pintle 10 so as to ensure that the lower portion 6 can bypass the blocking device 3.

The illustrated blocking device 3 is constructed and mounted in such a way that it can simply arrest the gate 2 on its way from the first toward the second open position, that it can simply arrest the gate on its way from the second to the first open position, or that it can actually lock the gate in the closed position. For this purpose, the blocking device 3 comprises a U-shaped or bifurcated member which defines a socket or recess 7 flanked by two prongs 8. The upper side 5 of the socket 7 is open, and the width of such socket (as measured at right angles to the plane of FIG. 1) at least matches the thickness of the respective part of the lower portion 6 of the gate 2. Thus, when the gate 2 is moved to a position in which the lower portion 6 is in register with the open upper end of the socket 7, and the gate is then allowed to descend by gravity, the lower portion 6 enters the socket 7 and the entire gate 2 is positively locked in the closed position. If such locking is not desired or necessary, the gate 2 is simply pivoted into abutment with the outer side of the one or the other prong 8.

If the device 3 is replaced with a simpler blocking means, e.g., a simple projection attached to or forming part of the platform 1, the gallery can be provided with a discrete locking device which releasably secures the gate 2 in the closed position. For example, the discrete locking device can comprise a vertically movable bolt 16 whose lower end portion can enter one of two blind bores 17 in the upper side of the platform 1. The selection of the bore 17 which is to receive the lower end portion of the bolt 16 depends upon whether the gate 2 is moved to closed position at the one or the other side of the blocking device 3.

Figure 2:
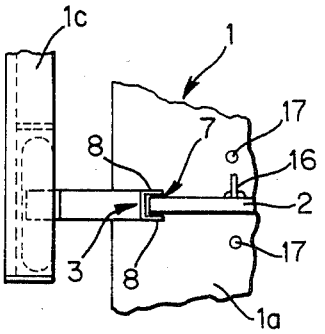
FIG. 2 is a fragmentary horizontal sectional view substantially as seen in the direction of arrows from the line II—II of FIG. 1.

Referring to FIG. 2, the lower portion 6 of the gate 2 can be readily extracted from the socket 7 by the simple expedient of lifting the entire gate with the pintle 10 and of thereupon pivoting the gate about the axis of the pintle toward the one or the other open position. This ensures that the gate 2 can be moved between open and closed positions irrespective of whether the respective end portion of the platform 1 extends all the way to a wall which prevents the gate from pivoting in one direction (namely, from the closed position to one of the two open positions). Since the blocking device 3 is remote from the balustrade 13, it can properly hold the gate 2 in the selected closed position (namely, in the closed and locked position which is shown in FIG. 2, in the closed position in which the lower portion 6 abuts against the outer side of one of the prongs 8, or in the closed position in which the lower portion 6 abuts against the outer side of the other prong 8) even if its height is minimal. This is desirable and advantageous because such relatively low blocking device constitutes a minor impediment or no impediment at all to transport of goods along the upper side of the platform 1 and/or to movements of workmen on the platform.

While it is possible to replace the illustrated single pintle 10 with two discrete coaxial pintles, the utilization of a single pintle is preferred at this time because the illustrated connecting means is simpler, more reliable and less expensive. Moreover, a single pintle invariably provides a well defined pivot axis for movements of the gate 2 between its open and closed positions.

The improved gallery further comprises preferably adjustable means for releasably securing the gate 2 to the balustrade 13 in the one or the other open position. Such securing means comprises a hook-shaped member or portion 14 which is carried by the gate 2 and is remote from the connecting means including the hinges 4 and 4'. The pallet of the hook-shaped portion 14 can enter a suitable hole or eyelet on the median rail 13*b* of the balustrade 13 or in or on the corresponding reinforcing member 12. In order to ensure that the portion 14 can properly engage any selected part of the balustrade 13 or a portion of a different balustrade (e.g., if the gate 2 is transferred onto a different gallery), the gate 2 is further provided with a vertically extending guide member 15 which adjustably supports the hook-shaped portion 14 so that the latter can be moved to any one of several different levels. To this end, the part 14*a* of the portion 14 is in frictional engagement with the vertical portion of the guide means 15. The purpose of the securing means including the hook-shaped portion 14 is to ensure that the gate 2 cannot accidentally leave the one or the other open position, e.g., right in front of a wheelbarrow which is loaded with building material and is to be moved along the platform 1 and beyond the gallery. If the gate 2 is to be pivoted to an open position in which the portion 14 extends beyond the respective end of the balustrade 13, the pallet of such portion can be releasably affixed to an adjacent part, such as a wall, a form for the pouring of concrete, a component of a scaffolding or the like.

The improved gallery can comprise two or more gates whose dimensions and/or other characteristics may but need not be identical with those of the illustrated gate. Moreover, and while it suffices if the lower portion 6 of the gate 2 can be lifted to a level only slightly above the upper end 5 of the socket 7, it is evidently possible to mount the gate for movement between the illustrated lowered position and a raised position in which the lower portion 6 is disposed at a level well above the blocking device 3. All that counts is to ensure that, in addition to its movement between open and closed positions, the gate 2 can further perform movements between a lowered position and a raised position in which latter position its lower portion 6 can bypass the blocking device 3 to thus enhance the versatility of the gate 2 and of the entire gallery.

The gate 2 is preferably moved to and locked in one of the open positions (by means of the hook-shaped portion 14) or in the closed position (either by the bolt 16 or by moving the lower portion 6 into the socket 7 of the blocking device 3) preparatory to transfer to storage or to a different locale of use. Such locking of the gate 2 is desirable because the latter cannot swing back and forth if the gallery is inclined during lifting to a desired level above the ground, during lowering onto the ground and/or during actual transport to another construction site or to storage.

Satisfactory guidance of the gate 2 during movement between raised and lowered positions is especially desirable if the blocking device 3 is formed with the aforediscussed socket 7 and if the width of such socket only slightly exceeds the thickness of the lower portion 6. Moreover, the provision of means for guiding the gate 2 between raised and lowered positions with a high degree of predictability reduces the likelihood of wobbling, extensive wear and generation of noise and promotes the facility with which the gate can be lifted in order to ensure that the lower portion 6 can bypass the device 3 or another suitable blocking device.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A gallery for supporting personnel and/or materials at an elevated level, comprising a support; a gate; means for articulately connecting said gate to said support so that the gate is movable between at least one open position and a closed position as well as between a raised and lowered position, at least while the gate assumes or approaches said closed position; and blocking means provided on said support and located in the path of movement of said gate in a direction from said open position beyond said closed position, said gate being arranged to bypass said blocking means in said raised position.

2. The gallery of claim 1, wherein said support includes an elongated platform and said gate is disposed at or close to one end of said platform.

3. The gallery of claim 1, wherein said connecting means includes at least one hinge defining for said gate an at least substantially vertical pivot axis for movement of said gate between said open and closed positions.

4. The gallery of claim 3, wherein said gate comprises a lower portion and said blocking means is located in the path of movement of said lower portion in the lowered position of said gate, said lower portion being located at a level above said blocking means in the raised position of said gate.

5. The gallery of claim 1, further comprising means for releasably locking said gate in said closed position.

6. The gallery of claim 5, wherein said blocking means has a first side and a second side and said gate is movable to either side of said blocking means when it assumes said raised position, said locking means being arranged to releasably lock said gate while the latter is adjacent to the one or the other side of said blocking means.

7. The gallery of claim 1, wherein said blocking means has a socket which is open from above and said gate has a portion which is located at a level above said socket in the raised position of said gate and is insertable into said socket in response to movement of said gate to said lowered position while said portion of the gate is in register with said socket.

8. The gallery of claim 7, wherein said blocking means has two prongs and said socket is a recess which is flanked by said prongs.

9. The gallery of claim 8, wherein said portion of said gate has a predetermined thickness and the width of said recess at least slightly exceeds the thickness of said portion.

10. The gallery of claim 7, wherein said blocking means includes a U-shaped member.

11. The gallery of claim 1, wherein said connecting means comprises at least one hinge having a substantially vertical pintle defining a pivot axis for movement of said gate between said open and closed positions, said hinge further having at least one eyelet for said pintle.

12. The gallery of claim 11, wherein said gate is movable between said raised and lowered positions in the axial direction of said pintle.

13. The gallery of claim 12, wherein said pintle is affixed to said gate and said eyelet is provided on said support; and further comprising means for limiting the extent of axial movement of said pintle relative to said eyelet.

14. The gallery of claim 13, wherein said pintle includes a portion which extends downwardly beyond said eyelet and said limiting means is provided on said portion of said pintle.

15. The gallery of claim 14, wherein said limiting means comprises an enlargement provided on said portion of the pintle and abutting against said eyelet in the raised position of said gate.

16. The gallery of claim 13, wherein said support includes a platform and a balustrade extending upwardly from said platform, said eyelet being provided on said balustrade.

17. The gallery of claim 16, wherein said blocking means is provided on said platform and is remote from said balustrade.

18. The gallery of claim 1, further comprising means for releasably securing said gate to said support in the open position of said gate.

19. The gallery of claim 18, wherein said connecting means defines for the gate a substantially vertical pivot axis for movement of the gate between said open and closed positions and said securing means comprises a portion provided on said gate and being remote from said pivot axis.

20. The gallery of claim 19, wherein said support includes a platform disposed below said gate and a balustrade extending upwardly from said platform and supporting said connecting means, said portion of said securing means being connectable to said balustrade in the open position of said gate.

21. The gallery of claim 19, further comprising means for adjustably mounting said portion of said securing means on said gate.

22. The gallery of claim 1, wherein said gallery is designed to be mounted adjacent to a structure undergoing erection, a form for the pouring of concrete, a facade of a building, and the like.

* * * * *